US009039080B2

(12) United States Patent
Guffey et al.

(10) Patent No.: US 9,039,080 B2
(45) Date of Patent: May 26, 2015

(54) SLIDING CHILD SEAT

(71) Applicants: Nathan Guffey, Seymour, TN (US); Carolyn Guffey, Seymour, TN (US)

(72) Inventors: Nathan Guffey, Seymour, TN (US); Carolyn Guffey, Seymour, TN (US)

( * ) Notice: Subject to any disclaimer, the term of this patent is extended or adjusted under 35 U.S.C. 154(b) by 0 days.

(21) Appl. No.: 13/909,630

(22) Filed: Jun. 4, 2013

(65) Prior Publication Data

US 2014/0152055 A1 Jun. 5, 2014

Related U.S. Application Data

(60) Provisional application No. 61/655,246, filed on Jun. 4, 2012.

(51) Int. Cl.
*A47D 1/10* (2006.01)
*A47D 1/00* (2006.01)

(52) U.S. Cl.
CPC ..... *A47D 1/106* (2013.01); *A47D 1/002* (2013.01)

(58) Field of Classification Search
CPC ..... A47D 1/106
USPC ..... 297/130, 136, 138, 143, 174 CS; 108/50.11, 50.14; 312/235.2, 235.3
See application file for complete search history.

(56) References Cited

U.S. PATENT DOCUMENTS

| | | | | |
|---|---|---|---|---|
| 1,501,443 | A | 7/1924 | Ellis | |
| 1,525,011 | A | 2/1925 | Stoltz | |
| 1,606,541 | A | 11/1926 | Straith | |
| 2,383,831 | A * | 8/1945 | Walker | 297/136 |
| 2,588,754 | A * | 3/1952 | Novi | 297/136 |
| 2,666,473 | A * | 1/1954 | Dean | 312/235.3 |
| 2,812,012 | A | 11/1957 | Hansburg | |
| 2,845,995 | A | 8/1958 | Landry | |
| 2,956,617 | A | 10/1960 | Bruderer | |
| 2,969,830 | A * | 1/1961 | Thompson | 297/136 |
| 3,126,226 | A | 3/1964 | Johnson | |
| 3,254,916 | A * | 6/1966 | Bass | 297/140 |
| 3,977,722 | A | 8/1976 | Gist | |
| 4,014,592 | A | 3/1977 | Gist | |
| 5,054,851 | A * | 10/1991 | Chiu | 297/136 |
| 5,329,865 | A | 7/1994 | McWard | |
| 5,451,093 | A | 9/1995 | Petrie et al. | |
| 5,531,159 | A | 7/1996 | Stubblefield | |
| 5,590,927 | A * | 1/1997 | Rapphahn | 297/143 |
| 5,685,603 | A | 11/1997 | Lane, Jr. | |
| 6,074,000 | A * | 6/2000 | Wagner | 297/188.11 |
| 6,679,549 | B2 | 1/2004 | Catelli | |
| 6,736,451 | B1 | 5/2004 | Chen | |
| 7,591,506 | B2 | 9/2009 | Flannery | |
| 7,651,161 | B2 | 1/2010 | Anselmi et al. | |
| 2008/0203780 | A1 | 8/2008 | Anelmi et al. | |
| 2008/0296938 | A1 | 12/2008 | Flannery | |

* cited by examiner

*Primary Examiner* — Peter Brown
(74) *Attorney, Agent, or Firm* — Pitts & Lake, P.C.

(57) ABSTRACT

A sliding child seat for use with a stationary surface, generally a stationary group dinging surface such as a kitchen counter-top, bar, or fixed table in a restaurant. In various embodiments, a sliding child seat for use with a stationary surface generally includes a frame member to receive a child seat, said frame member being connected to the stationary surface by sliding means, said frame member being switchable between a retracted position and an extended position, said frame member defining an aperture and having an inner perimeter, and a child seat to sit in said frame member when said frame member is in said extended state, said child seat having a lower portion and an upper portion, said lower portion fitting through the aperture defined by said frame member, said lower portion having an outer perimeter smaller than the inner perimeter of said frame member.

12 Claims, 2 Drawing Sheets

SLIDING CHILD SEAT

CROSS-REFERENCE TO RELATED APPLICATIONS

This Application claims the benefit under 35 U.S.C. section 119(e) of U.S. Provisional Patent Application Ser. No. 61/655,246, filed Jun. 4, 2012.

STATEMENT REGARDING FEDERALLY-SPONSORED RESEARCH OR DEVELOPMENT

Not Applicable

BACKGROUND OF THE INVENTION

1. Field of Invention

The present invention relates generally to child seats and more particularly to movable seating for young children.

2. Description of the Related Art

High chairs and other seats for toddlers and small children often have significant drawbacks. In addition to complications arising from the storage and positioning of a large, awkwardly shaped high chair, it will be observed that many high chairs and other child seating, despite elevating the child to some extent, nevertheless fail to raise the child to a height commensurate with the level of the communal, family, or group eating surface, such as a kitchen table, a kitchen counter or bar, or a table in a restaurant.

A need is felt for a form of child seating that is easily stored, readily available, and positions the child at a height comparable to the group eating surface.

BRIEF SUMMARY OF THE INVENTION

The present general inventive concept, in some of its several example embodiments, includes a sliding child seat for use with a stationary surface, generally including a frame member to receive a child seat, said frame member being connected to the stationary surface by sliding means, said frame member being switchable between a retracted position and an extended position, said frame member defining an aperture and having an inner perimeter, and a child seat to sit in said frame member when said frame member is in said extended state, said child seat having a lower portion and an upper portion, said lower portion fitting through the aperture defined by said frame member, said lower portion having an outer perimeter smaller than the inner perimeter of said frame member.

In some embodiments, said sliding means include a moving member and a stationary member.

In some embodiments, said moving member is connected to said frame member and said stationary member is connected to the stationary surface.

In some embodiments, said sliding means comprise ball bearings.

In some embodiments, said sliding means include a bearing slide.

In some embodiments, the stationary surface includes a table.

In some embodiments, the stationary surface includes a bar top, a kitchen counter, or a table.

The present general inventive concept, in some of its several example embodiments, includes sliding child seat for use with a stationary surface, including a frame member to receive a child seat, said frame member defining an aperture and having an inner perimeter, a sliding apparatus to connect said frame member to the stationary surface, said frame member being switchable between a retracted position and an extended position through the operation of said sliding apparatus, said sliding apparatus including a moving member and a stationary member, said moving member being connected to said frame member and said stationary member being connected to the stationary surface, and a child seat to sit in said frame member when said frame member is in said extended state, said child seat having a lower portion and an upper portion, said lower portion fitting through the aperture defined by said frame member, said lower portion having an outer perimeter smaller than the inner perimeter of said frame member.

In some embodiments, said child seat further includes a member that prevents said frame member from switching to said refracted position when said child seat is in said frame member.

In some embodiments, said sliding means comprise ball bearings.

In some embodiments, said sliding means comprise a bearing slide.

In some embodiments, the stationary surface comprises a bar top, a kitchen counter, or a table.

BRIEF DESCRIPTION OF THE DRAWINGS

The above-mentioned and additional features of the invention will become more clearly understood from the following detailed description of the invention read together with the drawings in which.

DETAILED DESCRIPTION OF THE INVENTION

Figure 1:
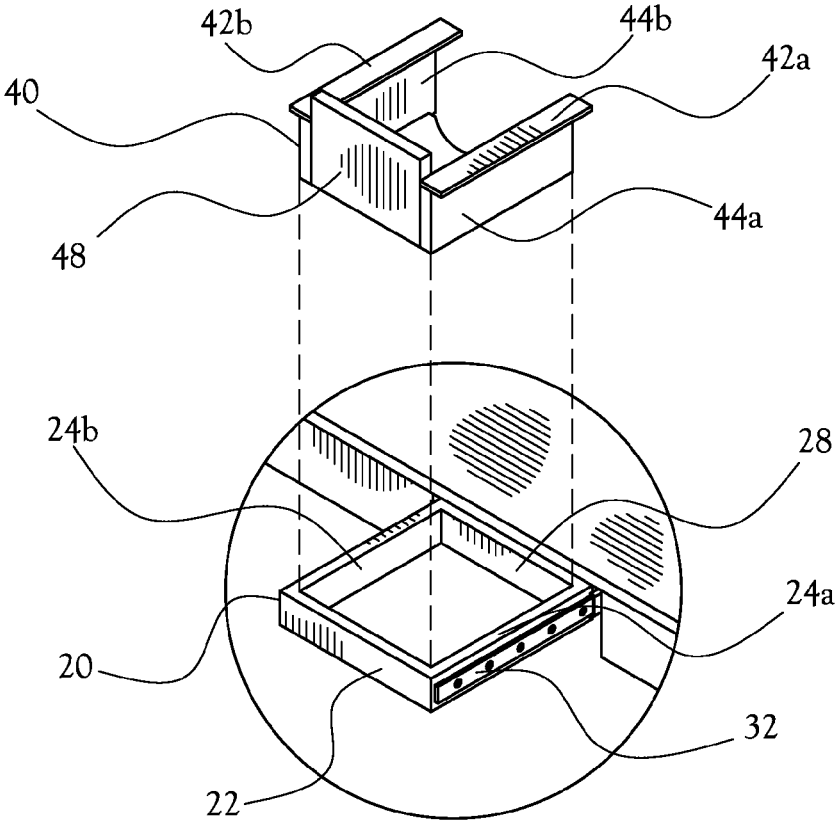
FIG. 1 is a perspective view of one example embodiment of the present general inventive concept, showing the child seat elevated above the frame member and the frame member is an extended state.

The present general inventive concept, in some of its embodiments, includes a sliding child seat.

In some of its many embodiments, the present general inventive concept generally comprises a sliding child seat with a frame member to receive and support a child seat. In some of its many embodiments, the present general inventive concept generally comprises a sliding child seat for use with a stationary surface, generally including: a frame member to receive a child seat, said frame member being connected to the stationary surface by sliding means, said frame member being switchable between a retracted position and an extended position, said frame member defining an aperture and having an inner perimeter; and a child seat to sit in said frame member when said frame member is in said extended state, said child seat having a lower portion and an upper portion, said lower portion fitting through the aperture defined by said frame member, said lower portion having an outer perimeter smaller than the inner perimeter of said frame member.

One example embodiment of a sliding child seat assembly according to the present general inventive concept is illustrated generally in FIGS. 1-4. As shown in FIGS. 1-4, a sliding child seat assembly according to the present general inventive concept generally comprises a slidable frame member 20 to receive a child seat 40. The frame member 20 is connected to a substantially stationary surface 50, such as a kitchen bar or a stationary table in a restaurant. Generally, the frame member 20 is adjustable between an extended state, shown in FIGS. 1 and 2, and a retracted state, shown in FIGS. 3 and 4.

In several example embodiments, including the example embodiment illustrated in FIGS. 1-4, the frame member 20 comprises an outer framing beam 22, an inner framing beam 28, a right side framing beam 24*a*, and a left side framing beam 24*b*. The framing beams cooperate to define an aperture to receive the bottom potion of the child seat 40. The inner faces of the framing beams (i.e., the faces that face the aperture described above) define an inner perimeter of the frame member 20.

Figure 2:
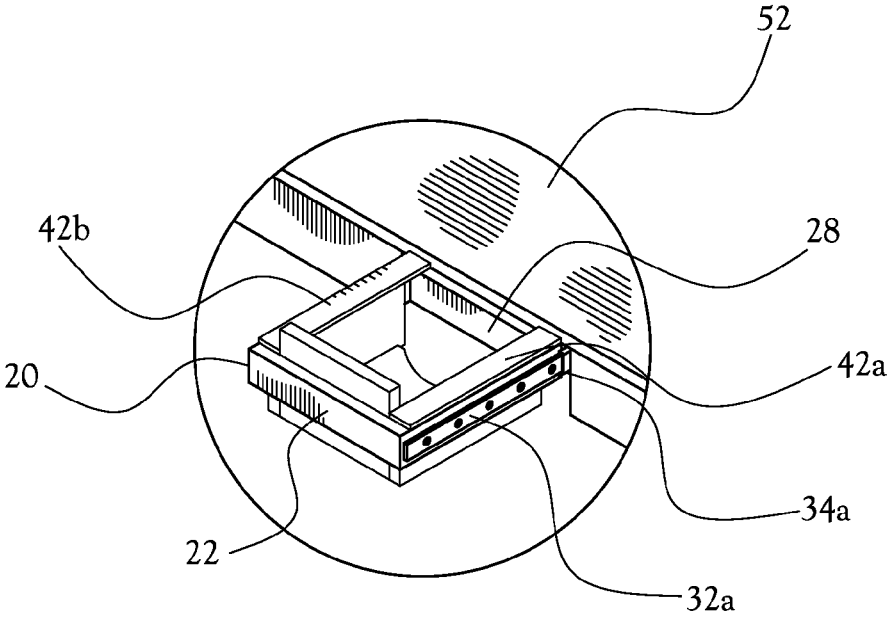
FIG. 2 is a perspective view of the example embodiment shown in FIG. 1, showing the child seat sitting in the frame member.

As shown in FIGS. 1 and 2, when the frame member 20 is in an extended state, the child seat 40 is lowered into the aperture defined by the frame member 20. Generally, the lower portion of the child seat 40 has an outer perimeter that is slightly smaller than said inner perimeter of the frame member 20.

Generally, in some embodiments, the child seat 40 includes at least a back member 48, a right side member 44*a*, a left side member 44*b*, a right arm member 42*a* positioned atop said right side member 44*a*, and a left arm member 42*b* positioned atop said left side member 44*b*.

When the child seat 40 is lowered into position in the frame member 20, as shown in FIG. 2, generally the back member 48 of the child seat 40 is positioned in close proximity to the outer framing beam 22 of the frame member 20; the right side member 44*a* of the child seat 40 is positioned in close proximity to the right side framing beam 24*a* of the frame member 20; and the left side member 44*b* of the child seat 40 is positioned in close proximity to the left side framing beam 24*b* of the frame member 20. In some embodiments, when the child seat 40 is in this position, the right arm member 42*a* of the child seat 40 sits on the right side framing beam 24*a*, and the left arm member 42*b* of the child seat 40 sits on the left side framing beam 24*b*, so that the arm members hold the child seat 40 in place on the frame member 20 and support the child seat and its occupant.

Figure 3:
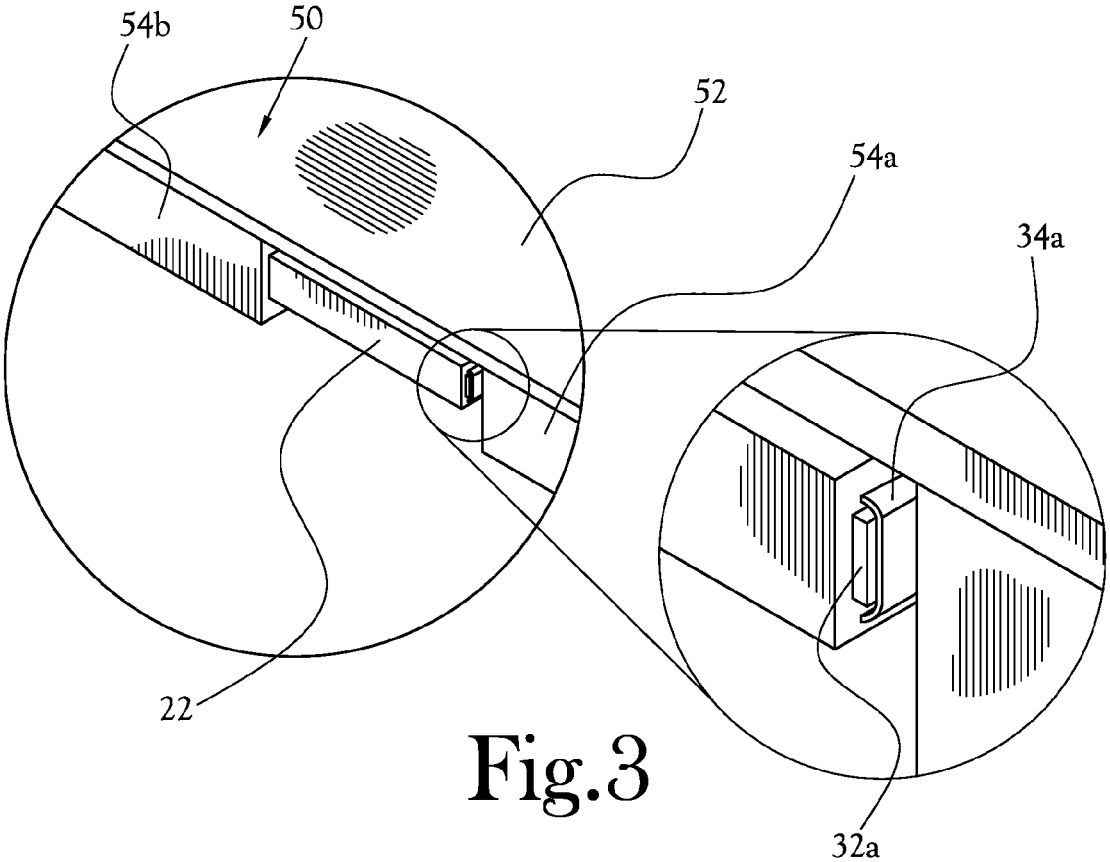
FIG. 3 is a perspective view of the example embodiment shown in FIGS. 1 and 2, showing the frame member in a retracted state.
Figure 4:
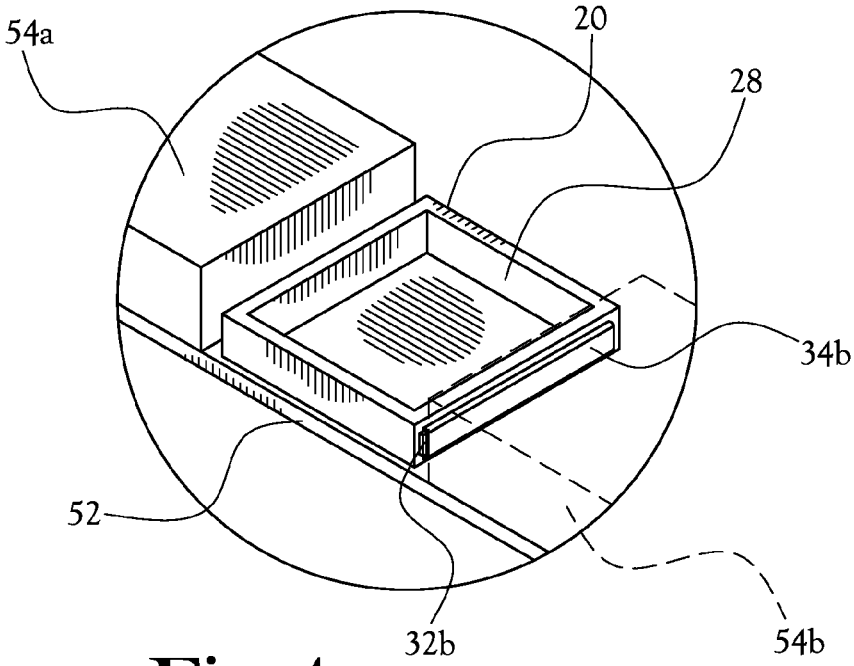
FIG. 4 is a rotated perspective view of the example embodiment shown in FIGS. 1, 2, and 3, showing the frame member in a retracted state, with the embodiment and stationary surface rotated 180 degrees.

FIGS. 3 and 4 illustrate the same example embodiment shown in FIGS. 1 and 2, showing the frame member in a retracted state; FIG. 4 presents a rotated perspective view of the example embodiment, with the embodiment and stationary surface rotated 180 degrees. As shown in FIGS. 1-4, the illustrated example embodiment includes sliding means that connect the frame member 20 to the stationary surface 50 and facilitate the sliding of the frame member 20 between an extended state and a retracted state. In the illustrated example embodiment, the sliding means comprise a pair of slider sets, one set positioned on either side of the frame member 20. Thus, on the right side of the frame member 20, a first slider set includes a first moving member 32*a* and a first stationary member 34*a*, with the first moving member 32*a* being attached to the right side framing beam 24*a* (for example, by screws or bolts, or by glue, or by other affixing means), and with the first stationary member 34*a* being attached to a right side component Ma of the stationary surface 50. Similarly, on the left side of the frame member 20, a second slider set includes a second moving member 32*b* and a second stationary member 34*b*, with the second moving member 32*b* being attached to the left side framing beam 24*b*, and with the second stationary member 34*b* being attached to a left side component 54*b* of the stationary surface 50.

In some embodiments, the sliding means include metal slides. In some embodiments, the sliding means comprise sliders with ball bearings. In some embodiments, the sliding means include bearing slides. Although some types of sliding means have been illustrated and described in detail herein, it is not the intention of the inventor to limit the present invention to the illustrated or described embodiments. Other types and designs of sliding means, and other means of attaching the frame member to the stationary surface, will be apparent to those of skill in the art and are contemplated by and encompassed by the present general inventive concept.

In some embodiments, as shown in FIG. 3, when the frame member 20 is in a retracted state, the frame member 20 is fully or substantially beneath the top surface component 52 of the stationary surface. Generally, when the frame member 20 is in a retracted state, the outer face of the outer framing beam 22 is flush with or recessed from outer faces of the right side component Ma and left side component 54*b* of the stationary surface 50. Generally, when the frame member 20 is in a retracted state, no portion of the frame member 20 protrudes or extends beyond the lip of the stationary surface 50.

In some embodiments, the child seat may include a rotating portion. In some embodiments, the child seat may include members to secure the child seat more securely to the frame member. Although some types of child seats have been illustrated and described in detail herein, it is not the intention of the inventor to limit the present invention to the illustrated or described embodiments. Other types and designs of child seats, and other means and methods of securing a child seat within the frame member, will be apparent to those of skill in the art and are contemplated by and encompassed by the present general inventive concept.

The present general inventive concept, in various embodiments, generally provides a form of child seating that is easily stored, readily available, and positions the child at a height comparable to the group eating surface.

While the present invention has been illustrated by description of some embodiments, and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A sliding child seat for use with a stationary surface with an edge, comprising:

a frame member to receive a child seat, said frame member being connected to the stationary surface by sliding means, said frame member being switchable between a retracted position and an extended position, said frame member defining an aperture and having an inner perimeter; and a child seat to sit in said frame member when said frame member is in said extended position, said child seat having a lower portion and an upper portion, said lower portion fitting through the aperture defined by said frame member, said lower portion having an outer perimeter smaller than the inner perimeter of said frame member, said child seat including arm rests, each said arm rest having a front edge, said front edge of said arm rest to contact the edge of the stationary surface to inhibit said frame member from switching to the retracted position when said child seat is in said frame member.

2. The sliding child seat of claim 1 wherein said sliding means comprise a moving member and a stationary member.

3. The sliding child seat of claim 2 wherein said moving member is connected to said frame member and said stationary member is connected to the stationary surface.

4. The sliding child seat of claim 1 wherein said sliding means comprise ball bearings.

5. The sliding child seat of claim 1 wherein said sliding means comprise a bearing slide.

6. The sliding child seat of claim 1 wherein the stationary surface comprises a table.

7. The sliding child seat of claim 1 wherein the stationary surface comprises a bar top, a kitchen counter, or a table.

8. A sliding child seat for use with a stationary surface having an edge, comprising:

a frame member to receive a child seat, said frame member defining an aperture and having an inner perimeter;

a sliding apparatus to connect said frame member to the stationary surface, said frame member being switchable between a retracted state and an extended state through the operation of said sliding apparatus, said sliding apparatus including a moving member and a stationary member, said moving member being connected to said frame member and said stationary member being connected to the stationary surface; and a removable child seat to sit in said frame member when said frame member is in said extended state, said child seat having a lower portion and an upper portion, said lower portion fitting through the aperture defined by said frame member, said lower portion having an outer perimeter smaller than the inner perimeter of said frame member, said child seat including at least one arm rest overlying said frame member, said arm rest having a front edge, said front edge of said arm rest to contact the edge of the stationary surface to prevent retraction of said frame member when said child seat is sitting in said frame member, whereby said arm rest prevents said frame member from switching to the refracted position when said child seat is in said frame member.

9. The sliding child seat of claim 8 wherein said sliding means comprise ball bearings.

10. The sliding child seat of claim 8 wherein said sliding means comprise a bearing slide.

11. The sliding child seat of claim 8 wherein the stationary surface comprises a bar top, a kitchen counter, or a table.

12. A sliding child seat for use with a stationary surface having an edge, comprising:

a frame member to receive a child seat, said frame member defining an aperture and having an inner perimeter;

a sliding apparatus to connect said frame member to the stationary surface, said frame member being switchable between a retracted position and an extended position through the operation of said sliding apparatus, said sliding apparatus including a moving member and a stationary member, said moving member being connected to said frame member and said stationary member being connected to the stationary surface, said sliding apparatus including ball bearings; and a removable child seat to be inserted within said frame member and to sit in said frame member when said frame member is in the extended position, said removable child seat being removed from said frame member before said frame member is switched from the extended position to the retracted position, said child seat having a lower portion and an upper portion, said lower portion fitting through the aperture defined by said frame member, said lower portion having an outer perimeter smaller than the inner perimeter of said frame member, said child seat including two arm rests overlying said frame member, each said arm rest having a front edge, said front edge of said arm rest to contact the edge of the stationary surface to prevent refraction of said frame member when said child seat is sitting in said frame member, whereby said arm rest prevents said frame member from switching to the retracted position when said child seat is in said frame member.

* * * * *